US011994134B2

(12) United States Patent
Baroncini et al.

(10) Patent No.: US 11,994,134 B2
(45) Date of Patent: May 28, 2024

(54) DRIVE PROTECTION AND MANAGEMENT METHOD OF A PRESSURIZATION SYSTEM

(71) Applicant: CALPEDA S.p.A., Montorso Vicentino (IT)

(72) Inventors: Tiziana Baroncini, Vicenza (IT); Daniele Frison, Cittadella (IT); Gianluca Marangon, Vicenza (IT); Alberto Marchetti, Camposampiero (IT); Damiano Mingardi, Caldogno (IT)

(73) Assignee: CALPEDA S.p.A., Montorso Vicentino (IT)

( * ) Notice: Subject to any disclaimer, the term of this patent is extended or adjusted under 35 U.S.C. 154(b) by 501 days.

(21) Appl. No.: 17/012,459

(22) Filed: Sep. 4, 2020

(65) Prior Publication Data

US 2021/0071673 A1 Mar. 11, 2021

(51) Int. Cl.
*F04D 15/00* (2006.01)
*F04B 13/00* (2006.01)
(Continued)

(52) U.S. Cl.
CPC ..... *F04D 15/0072* (2013.01); *F04B 13/00* (2013.01); *F04B 17/03* (2013.01); *F04B 23/04* (2013.01); *F04B 49/065* (2013.01); *F04B 49/08* (2013.01); *F04B 49/20* (2013.01); *F04B 51/00* (2013.01); *F04D 1/00* (2013.01); *F04D 13/06* (2013.01); *F04D 13/12* (2013.01); *F04D 15/00* (2013.01); *F04D 15/0066* (2013.01); *F04D 15/0077* (2013.01); *F04D 15/0088* (2013.01);
(Continued)

(58) Field of Classification Search
CPC ..... F04B 49/065; F04B 13/00; F04B 49/20; F04B 49/06; F04B 17/03; F04B 2205/09; F04B 49/08; F04B 51/00; F04B 2205/05; F04B 23/04; F04D 15/0066; F04D 15/0088; F04D 15/029; F04D 1/00; F04D 13/06; F04D 13/12; F04D 15/0072; F04D 15/0245; F04D 15/00; F04D 15/0077; F04D 15/02
See application file for complete search history.

(56) References Cited

U.S. PATENT DOCUMENTS 5,303,551 A * 4/1994 Lee ..... E02F 9/2221 60/431
5,846,056 A * 12/1998 Dhindsa ..... F04B 49/065 73/152.52
(Continued)

*Primary Examiner* — Peter J Bertheaud
(74) *Attorney, Agent, or Firm* — Greenberg Traurig

(57) ABSTRACT

The disclosure relates to a drive protection and management method of a pressurization system comprising at least two operatively independent hydraulic pumps, the method including setting a plurality of predetermined parameters by a user by means of an electronic control unit at each of the hydraulic pumps, detecting at least one pressure value by means of at least one pressure sensor at a delivery duct of each of the hydraulic pumps, determining a drive in a sequential and/or synchronized manner of the at least two hydraulic pumps by managing and interpolating, independently for each pump, these predetermined parameters and the at least one pressure value at each of the hydraulic pumps by means of each electronic control unit. The disclosure relates to a pressurization system as well, adapted to implement this method.

10 Claims, 4 Drawing Sheets

(51) Int. Cl.

| | |
|---|---|
| ***F04B 17/03*** | (2006.01) |
| ***F04B 23/04*** | (2006.01) |
| ***F04B 49/06*** | (2006.01) |
| ***F04B 49/08*** | (2006.01) |
| ***F04B 49/20*** | (2006.01) |
| ***F04B 51/00*** | (2006.01) |
| ***F04D 1/00*** | (2006.01) |
| ***F04D 13/06*** | (2006.01) |
| ***F04D 13/12*** | (2006.01) |
| ***F04D 15/02*** | (2006.01) |

(52) U.S. Cl.
CPC ..... *F04D 15/02* (2013.01); *F04D 15/0245* (2013.01); *F04D 15/029* (2013.01); *F04B 2205/05* (2013.01); *F04B 2205/09* (2013.01)

(56) References Cited

U.S. PATENT DOCUMENTS 6,672,055 B1 * 1/2004 Konishi ..... F04B 49/08 60/449
7,588,423 B2 * 9/2009 Takao ..... F04B 11/0075 417/252
9,091,259 B2 * 7/2015 Tamminen ..... F04B 23/04

* cited by examiner

DRIVE PROTECTION AND MANAGEMENT METHOD OF A PRESSURIZATION SYSTEM

CROSS-REFERENCE TO RELATED APPLICATIONS

The present application claims the benefit of filing date of Italian Pat. App. Ser. No. 102019000015674, filed Sep. 5, 2019, the entire disclosure of which application is hereby incorporated herein by reference.

FIELD OF TECHNOLOGY

The present disclosure relates to a drive protection and management method of a pressurization system comprising at least two hydraulic pumps, in particular for a start and stop optimization of said hydraulic pumps.

The aforementioned method finds a useful application particularly, but not exclusively, in the field of pumps and pressurization units equipped with fixed or variable speed electric motors, both in the civil sector and in the industrial sector.

The present disclosure relates to a pressurization system as well adapted to implement this method.

BACKGROUND

It is known, in the present field, that plants for pumping liquids, in particular water for civil or industrial use, are generally equipped with suitable pressurization systems or units which comprise one or more fixed and/or variable speed electric pumps for powering the distribution network. One or more autoclaves and one or more pressure switches and/or flow meters are connected to the system.

In small plants, autoclaves consist of a tank in which an elastic diaphragm separates a first chamber containing pressurized air from a second chamber connected to the distribution network. A certain amount of water is thus collected in the chamber connected to the distribution network to make the plant operation more flexible avoiding too frequent starts and stops of the pumps. In fact, when the pressure in the distribution network decreases, the delivery to users occurs without the pumps starting to operate, by exploiting the water contained in the second chamber. This water is put into circulation by the thrust generated by the compressed air being present in the first chamber which acts on the diaphragm.

The delivery continues until a minimum pressure value predefined by the user is reached in the network, below which a pressure switch starts the pump to recover the recommended maximum pressure in the network and in the tanks. Upon reaching the maximum pressure, the maximum pressure switch stops the pumps.

From the present description it is thus understood how the autoclaves carry out a cushioning function which allows too close starts and stops of the pumps to be avoided, which could damage the impeller and the connection which makes the impeller integral with the shaft.

Nevertheless, it is not a remote event that autoclaves break down because of the breakage of the elastic diaphragm or of the compressed air supply system. In these situations, the autoclave cushioning effect ends whereby it is enough that any user requires even a small amount of water from the network for the pumps to be started. In this situation, as consumptions change, the pump or pumps included in the pressurization plant are started and stopped in a sudden and continuous manner leading shortly to the damage of the electric drives and, in particular, of the contactors which operate the motors of the electric pumps.

Consequently, a diffuse damage in all the components of the pressurization plant and an obvious worsening in delivering water to final users occur.

At present, in order to remedy these drawbacks, specific solutions and methods are looked for, which allow the drive of the pumps to be adjusted by adopting autonomous and independent pressurization units, and the system electric drives to be protected accordingly.

In this context Italian patent No. 0001336166 shows a method and system for protecting electric drives in electric pumps wherein the analogue control board of the pumps is removed.

According to a similar principle applied to analogue-digital hybrid solutions, U.S. Pat. No. 9,863,425 B2 removes the centralized electronic control device for managing pressure and flow rate signals aiming at ensuring at the same time the water delivery according to the comfort parameters expected by the users.

However, these systems do not ensure a prompt solution to the problem of protecting the electric drives of the adopted pumps yet.

Spanish patent ES 2,620,685 B1 suggests a further solution for parallel pump systems operating in a different manner depending on different detected configurations.

Although advantageous, this solution is particularly complex and not easy to carry out when setting operating configurations.

For this reason, aim of the present disclosure is to provide a method which does not incur the drawbacks of the prior art and which allows the electric drives of a pressurization system to be protected by efficiently controlling the number of drives of each pump.

A further aim is to provide a method which is able to optimize the number of drives of a pressurization system by using as data measured in real time the only delivery pressure of each pump of the pressurization system.

Another aim is to provide a method which allows the pumps to be used in an independent manner from each other while ensuring the global reliability of the pressurization system and the minimization of wear events of the mechatronic components.

Another aim is to provide a method and system which allows an implementation in pre-existing assemblies by only replacing the adopted pump or pumps.

A further aim is to provide a method and system which can be used in a prompt and highly intuitive manner by a user without requiring particularly specific skills.

Finally, a further aim is to provide a method and system which can be implemented in a cost-effective manner.

SUMMARY OF THE DISCLOSURE

The solution idea underlying the present disclosure is to provide a method which allows the operation of a pressurization system to be identified by minimizing the number of parameters detected in a continuous manner and implementing a derivation algorithm based on a series of preset parameters.

The aforementioned technical problem is solved by a drive protection and management method of a pressurization system comprising at least two operatively independent hydraulic pumps, including setting a plurality of predetermined parameters by a user by means of an electronic control unit at each of the hydraulic pumps, detecting at least one pressure value by means of at least one pressure sensor at a delivery duct of each of the hydraulic pumps and determining a drive in a sequential and/or synchronized manner of the at least two hydraulic pumps by managing and interpolating the predetermined parameters and the at least one pressure value at each of the hydraulic pumps by means of each electronic control unit.

Advantageously, the present method allows the number of switching on and off actions of a pressurization system to be optimized, minimizing and anyway equally distributing the wear of mechatronic components.

According to a particular embodiment the method according to the disclosure further comprises calibrating the pressurization system, wherein at least one system maximum pressure is defined and set.

Advantageously this allows possible calibration deviations between pressure sensors which are present on different pumps of the pressurization system to be avoided.

Preferably, defining an operating range which is common to all the hydraulic pumps of the pressurization system is further provided.

Advantageously this allows the wear level of the mechatronic components involved in the pressurization system to be further optimized.

Still preferably, the method according to the disclosure further comprises generating a temporary index which is typical of each of the hydraulic pumps.

Advantageously this temporary index allows a method update law to be implemented for an iteration thereof in time.

More preferably the method according to the disclosure provides a detection of a plurality of pressure values by means of at least one pressure sensor at the delivery duct of each of the hydraulic pumps and calculating at least one first derivative of an interpolating function of this plurality of values by means of the electronic control unit at each of the hydraulic pumps.

Advantageously, this calculation allows the trend of the measured pressure to be determined and the circuit needs required by the users to be met in a timely manner.

Preferably the method according to the disclosure further comprises identifying and setting a waiting time in a sequential drive of the hydraulic pumps.

Advantageously, this specification allows an improved distribution of switching on and off actions of the pumps of the pressurization system to be obtained.

More preferably the method further comprises correcting by means of a correction constant the waiting time set in the electronic control unit at each of the hydraulic pumps.

Advantageously this constant stored in the installation according to a predictive function allows the waiting time value to be corrected over time.

According to a particular embodiment the method according to the disclosure further provides an iterative repetition of at least two operations of the method.

Advantageously this aspect allows a continuous update of the pressurization system state and an update of the system response.

According to an example not belonging to a claimed invention, the drive protection and management method of a pressurization system further comprises setting at least one threshold constant and/or at least one minimum operating range between a start pressure and a stop pressure.

Advantageously this is particularly effective for the implementation in systems already controlled by a single control board.

Preferably, switching on and off ranges are detected and determined by means of a time counter.

Advantageously this solution is effective for the aforementioned systems already controlled by a single control board.

According to another aspect of the present disclosure, a pressurization system is provided, comprising at least two hydraulic pumps, at least one pressure sensor at a delivery duct of each of the hydraulic pumps and an electronic control unit at each of the hydraulic pumps, this pressurization system being adapted to perform a method according to the disclosure.

Advantageously, the system according to the disclosure allows the internal electromechanical elements to be protected through a proper relation of switching on and off actions.

Further features and advantages will be more apparent from the following detailed description of a preferred, but not exclusive, embodiment of the present disclosure, with reference to the attached figures given by way of non-limiting example.

DETAILED DESCRIPTION

Figure 1:
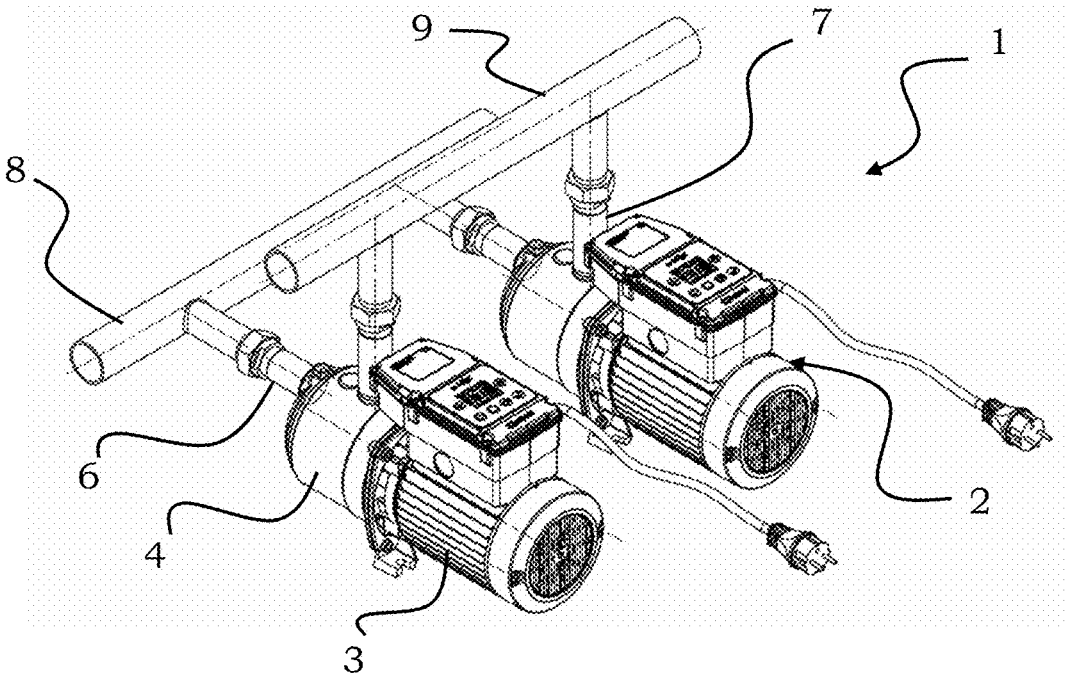
FIG. 1 represents a perspective view of an exemplary pressurization system according to a first embodiment of a method of the present disclosure.
Figure 2:
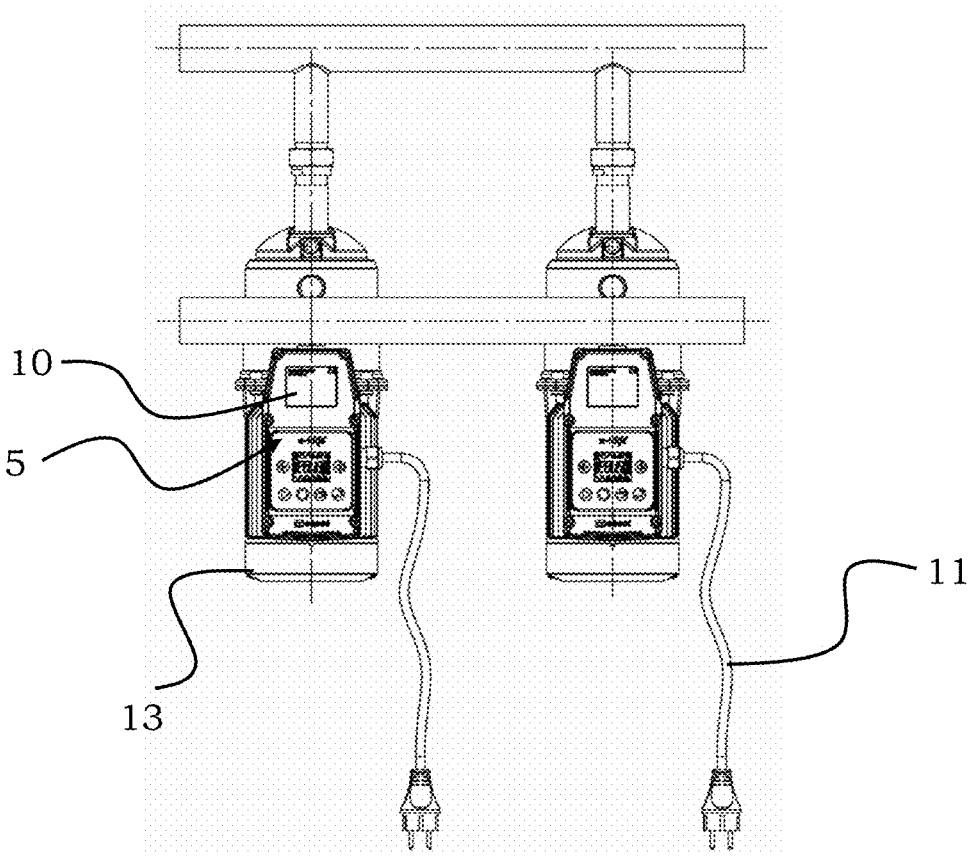
FIG. 2 represents a top view of the pressurization system of FIG. 1.
Figure 3:
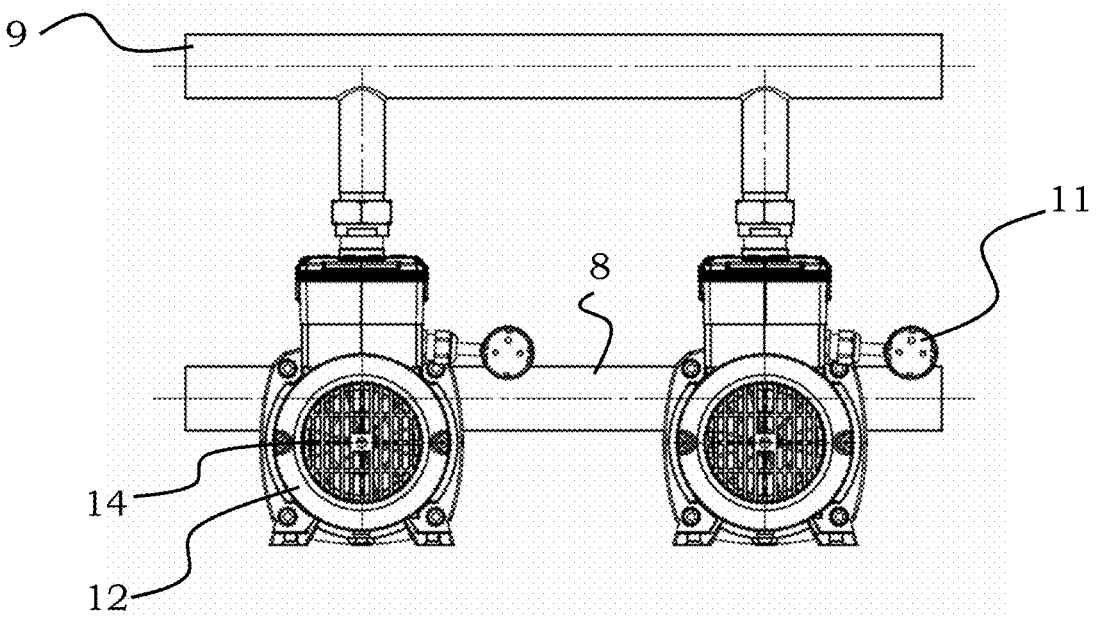
FIG. 3 represents a front view of the pressurization system of FIG. 1.
Figure 4:
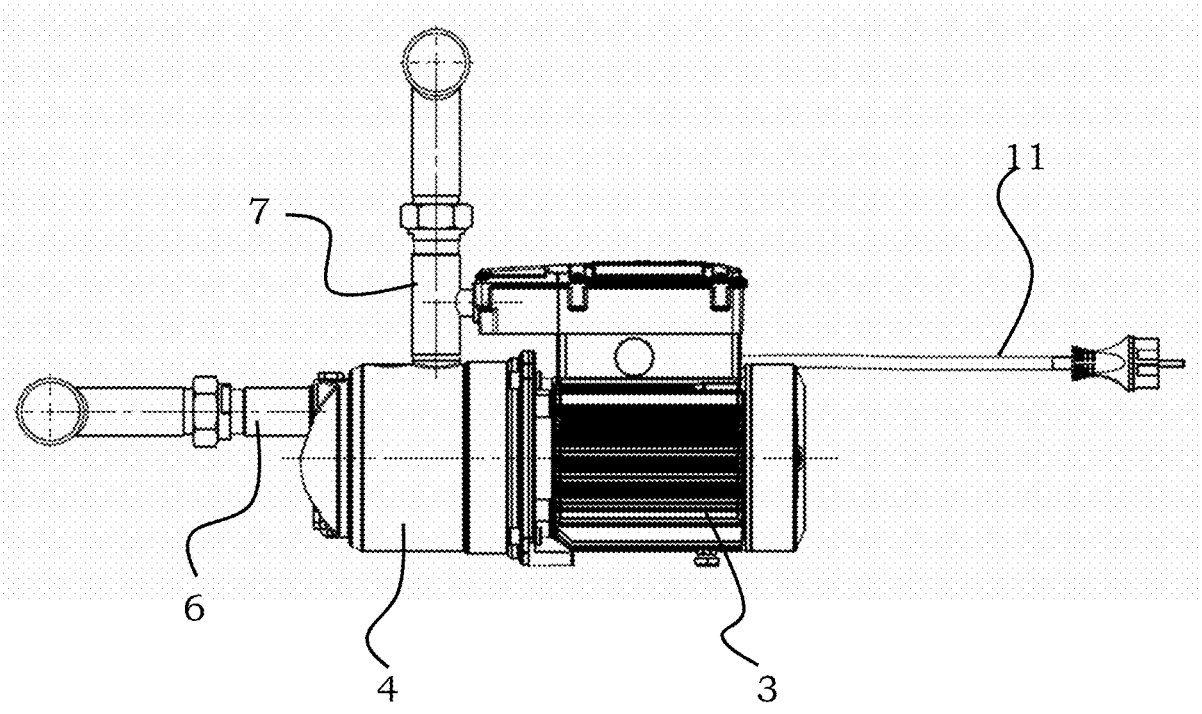
FIG. 4 represents a side view of the pressurization system of FIG. 1.

With reference to the figures, reference number 1 globally and schematically indicates a pressurization system, made according to the present disclosure.

FIGS. 1 to 4 represent in particular a pressurization system 1 comprising two hydraulic pumps 2. This embodiment is exemplary and non-limiting of the scope of protection defined by the attached claims, as it will also be more apparent herebelow. In fact, in general the pressurization system 1 can provide a number np of associated hydraulic pumps 2.

Each hydraulic pump 2 comprises an electric motor 3 and a hydraulic unit 4. Each hydraulic pump 2 comprises an electronic control unit 5.

The electric motor 3 and the hydraulic unit 4 are kinematically coupled by means of a driving shaft (not shown).

The electric motor 3 is preferably of the asynchronous two-phase type.

A liquid suction duct 6 and a liquid delivery duct 7 branch off from the hydraulic unit 4, which are coupled with a supply pipe 8 and a distributing pipe 9 of the pressurization system 1 respectively, preferably by threaded coupling.

The electric motor 3, in the exemplary embodiment of FIG. 1, is laterally coupled to the electronic control unit 5. The electronic control unit 5 comprises an electronic control board (not shown) and an interface display 10. The electronic control unit is powered by means of a connecting cable 11.

The electronic control unit 5 further comprises a pressure sensor (not shown), connected to the electronic control board. The pressure sensor is adapted to detect the pressure of the liquid inside the liquid delivery duct 7, and therefore to adjust the start/stop cycles of the pressurization system 1. Each hydraulic pump 2 comprises a pressure sensor. The present specification is exemplary and non-limiting of the scope of protection defined by the attached claims, as it will also be more apparent herebelow.

The electric motor 3 is cooled by means of a cooling fan 12 splined to the driving shaft at a rear closure 13. The cooling fan 12 is accommodated in a ventilated housing 14, coupled to the rear closure 13.

The electronic control unit 5 is adapted to manage and control at least one operating parameter of the hydraulic pump 2 of the pressurization system 1, in particular by means of the detections of the pressure sensor integrated in the structure of the hydraulic pump 2.

The variables managed and controlled by the electronic unit 5 comprise particularly, but not exclusively, the manometric pressure Hs measured by the pressure sensor of each hydraulic pump 2, the plant minimum pressure Hmin set by the user, the plant maximum pressure Hmax set by the user, a time unit Δt fixed equal for each hydraulic pump 2 in the installation.

Further, the electronic control unit 5 associates an individual temporary number Np with each hydraulic pump 2, which is variable from 1 to np, np being variable depending on the specific case, and an individual index n for each hydraulic pump 2.

Still further, in an embodiment with sequential switching on actions, a waiting time Tatt is determined, which is related to the time shift with which a sequential switching on or off of the hydraulic pumps 2 of the pressurization system 1 occurs.

A correction constant Kpc is also associated with the waiting time Tatt. This correction constant Kpc performs a predictive correction based on the evolution of the value of the first derivative and of the sign of the second derivative of the function interpolating the pressure measured by the sensor of each hydraulic pump 2. The values of the correction constant Kpc are storable in tables which can be modified in the installation of the pressurization system 1. If distributed withdrawals by the users occur the value of Kpc is comprised between zero and one. On the contrary, in case of detection of very small withdrawals with minimum pressure losses, for example under dripping conditions, the value of Kpc is much greater than 1.

As a result, the waiting time parameter Tatt for each pump with the individual temporary number Np is determined as $TattNp=Kpc*Np*\Delta t$.

According to a first embodiment calibrating the pressurization system 1 follows at the end of installing and setting parameters. In this operation the pressurization system 1 is pressurized at the maximum pressure Hmax. The maximum pressure Hmax is measured by any hydraulic pump 2 comprised between the np hydraulic pumps of the pressurization system 1. This hydraulic pump 2 is thus set as the reference hydraulic pump of the system and all the pressures measured by the sensors of each pump of the pressurization unit are defined as Hmax. This calibration allows possible calibration deviations of the pressure sensors of each hydraulic pump 2 to be avoided. A similar calibration can be further set regarding the minimum pressure Hmin. In this calibration the correction parameter Kpc is set equal to one.

Afterwards, defining an operating range is provided, defined by the maximum pressure Hmax and by the minimum pressure Hmin, which are common to all the hydraulic pumps 2 of the pressurization system 1.

An individual temporary number Np comprised between 1 and np is associated with the hydraulic pumps 2 which are different from the reference hydraulic pump.

Upon starting the pressurization system 1 each pressure sensor detects the manometric pressure Hs and the electronic control unit 5 determines the function interpolating the trend of the manometric pressure Hs and the first and second derivatives of this interpolating function.

If the value of the manometric pressure Hs is lower than the minimum pressure Hmin, the hydraulic pump 2 corresponding to the value one of Np is started and stays on until the manometric pressure Hs is higher than the maximum pressure Hmax.

Further, if the first and second derivatives indicate that the pressure in the circuit is increasing, a value which is higher than one is allocated to the correction constant Kpc, selected between the listed values as a function of the slope of the function of the detected manometric pressure Hs. In such conditions the hydraulic pump 2 corresponding to the value one of Np is bringing the pressure back to reference conditions providing the users with a delivery complying with the plant specifications.

If the first and second derivatives indicate that the pressure in the circuit is decreasing a value which is lower than one is allocated to the correction constant Kpc, selected between the listed values as a function of the slope of the function of the detected manometric pressure Hs.

In such conditions the hydraulic pump 2 corresponding to the value one of Np is not bringing the circuit pressure back to reference conditions and is not providing the users with a delivery complying with the specifications. Thereby TattNp is dynamically modified to meet the delivery request by the users with the highest possible comfort.

All the pumps steadily stay in the Hs monitoring without switching on for a time duration that is equal to TattNp. Only the pump with the individual temporary number Np which is equal to one has the waiting time value Tatt which is equal to zero.

Once the shorter observation time is elapsed, i.e. the one corresponding to the hydraulic pump 2 with the individual temporary number which is equal to two, if the manometric pressure value Hs measured by the pressure sensor is lower than the maximum pressure Hmax, this hydraulic pump also switches on. Similarly, the same is carried out for all the other hydraulic pumps 2 with the sequential order determined by the value TettNp.

When the manometric pressure Hs measured by the pressure sensor in each pump is higher or equal to the maximum pressure Hmax all the hydraulic pumps switch off since the whole circuit is pressurized according to the required specifications.

Once all the hydraulic pumps 2 are switched off the individual indices of the hydraulic pumps 2 are updated according to the following law:

If Np=np then Np=1 is set

If Np=n then Np=n+1 is set

The described first embodiment is particularly effective in equally distributing wear in the mechatronic components of the hydraulic pumps 2.

Figure 5:
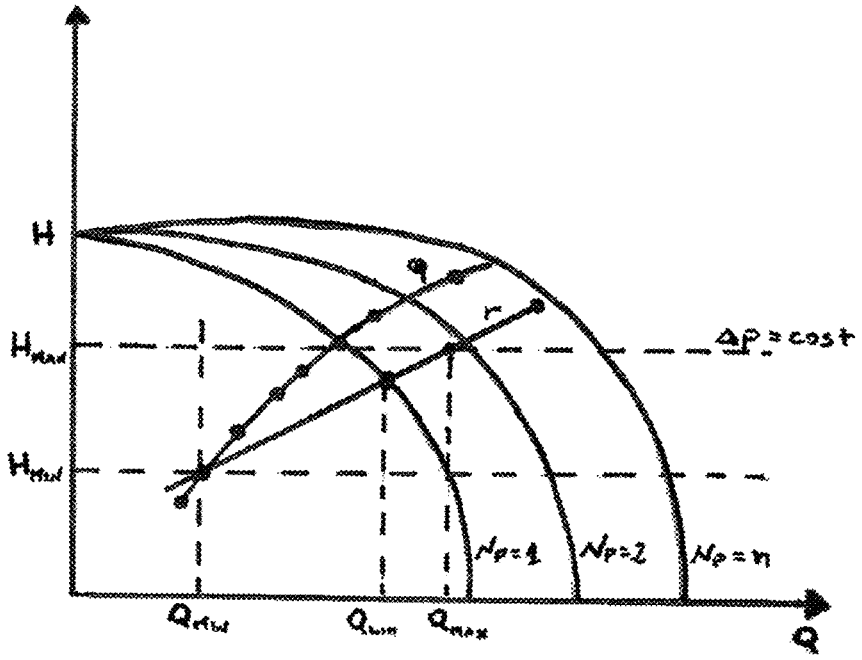
FIG. 5 represents an exemplary diagram of operation of a method according to the present disclosure.

In FIG. 5 the diagram of operation and performances of the pressurization system 1 provided with np pumps of the just described type is represented in a graph Q/H, where Q is the flow rate required to the pressurization implant and H the relevant hydraulic head. Curves of operation with steady, proportional and quadratic H are further represented.

In a second embodiment of the disclosure in the initial operation the individual temporary number Np comprised between the values one and np is generated and associated in a random manner with each pump, and for each of them the electronic control unit 5 calculates the waiting time parameter TattNp as described.

Switching on and off the pumps which is similar to the one provided in the first embodiment then follows.

Once the switching off of all the pumps is completed, an iterative repetition is thus provided.

In the described second embodiment an overlap of the individual temporary number Np for several hydraulic pumps can occur and these hydraulic pumps can thus switch on at the same time. In that case the operating time is proportionally reduced, improving the distribution of the stochastic process.

Alternately it is possible to provide a switching on and off of the hydraulic pumps 2 determined by the electronic control unit 5 based on ranges between the maximum pressure Hmax and the minimum pressure Hmin, suitably shifted for each hydraulic pump 2 of the pressurization system 1.

In this case, in the electronic control unit 5 the variable defined as "shift", i.e. a threshold constant, is set, being required to define the switching on and off ranges of each hydraulic pump 2. The definition of the switching on and off ranges is detected and determined by means of a time counter. Further a minimum operating range x between the switching on pressure and the switching off one of each hydraulic pump 2 is set, in order to carry out an optimal distribution of the switching on time of each hydraulic pump 2 and reduce the number of starts per hour. The minimum range x is generally, but not limitedly, fixed between 1 and 1.5 bar.

Each hydraulic pump 2 is identified by means of an identification index ID.

By defining a suitable threshold constant "shift" the distribution of all the operating ranges of the hydraulic pumps 2 is set.

Indicating with t a measuring tolerance of the pressure sensor, a threshold constant "shift" that is greater than t and equal for all the hydraulic pumps 2 is fixed. For each hydraulic pump 2 the switching on pressure Pstart, stop pressure Pstop values and the number of pumps np are set.

Preferably, but not exclusively, the following law is adopted:

$$P\text{stop},i=P\text{stop}-i\cdot\text{shift}$$

$$P\text{start},i=P\text{start}+(np-i)\text{shift}$$

Starting from boundary conditions to be fulfilled:

$$\text{shift}=(P\text{stop}-P\text{start}-x)/(np-1)$$

$$\text{shiftmin}=t$$

An operation law is obtained:

$$(P\text{stop},\text{min}-P\text{start},\text{max})=\Delta P\text{min}=t\cdot(np-1)+x$$

Each pump, based on the identification index ID thereof set by the user, is set according to its own i-th thresholds, so as to equally split the operating pressure ranges. In order to subject the pumps to a similar degree of wear, an alternation of operation of the hydraulic pumps 2 is obtained by suitably swapping the reference index ID of each of them. In fact, keeping each pump completely autonomous from the other ones, a supply network voltage period of the pressurization unit 1 as a clock function is preferably used as a synchronising signal for swapping the identification index ID. The supply network voltage period is measured by calculating the sinusoidal voltage peaks. The preferred but not exclusive selection of this signal makes the synchronism very strong since, even in case of fluctuation of the network frequency, the hydraulic pumps would stay synchronized, being all exposed to the same fluctuation.

Hence, the operating time of the single hydraulic pump 2 is calculated and the index ID swapping is suitably selected accordingly.

Alternately, it is possible to use microcontrollers with integrated RTC (Real Time Clock).

Figure 6:
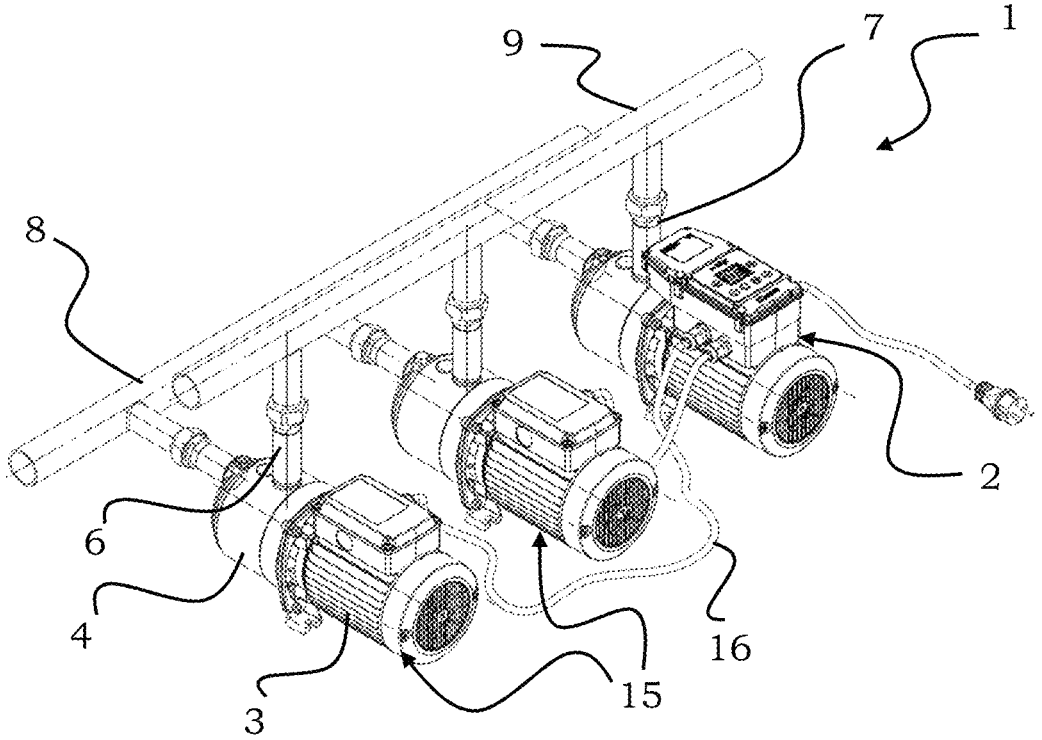
FIG. 6 represents a perspective view of an exemplary pressurization system not belonging to a claimed invention.
Figure 7:
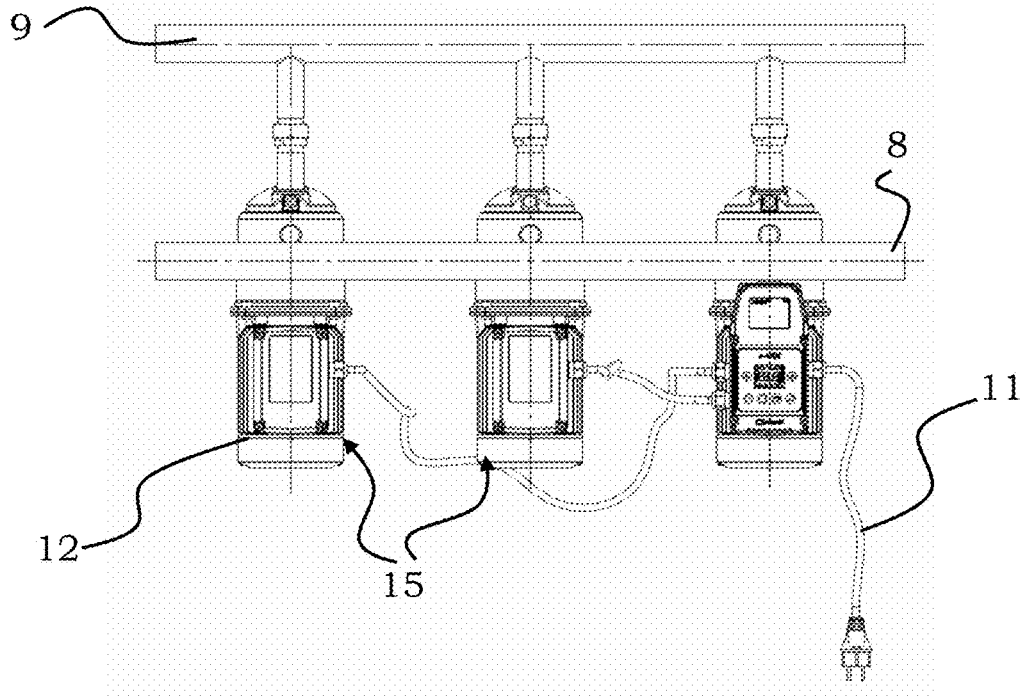
FIG. 7 represents a top view of the pressurization system of FIG. 6.
Figure 8:
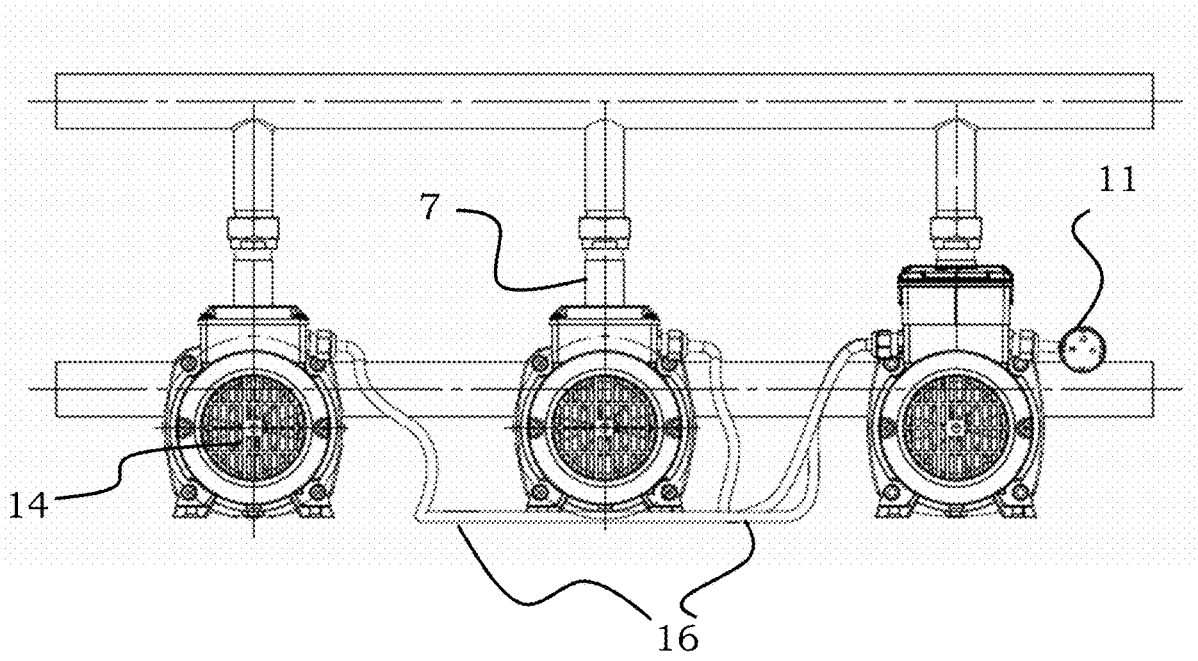
FIG. 8 represents a front view of the pressurization system of FIG. 6.

In FIGS. 6 to 8 a pressurization system 1, not belonging to a claimed invention, is represented, comprising three hydraulic pumps 2, of which a reference hydraulic pump 2 and two interlocked hydraulic pumps 15 powered by the electronic control unit 5 of this hydraulic pump 2 operating with one of the above-described methods. The interlocked hydraulic pumps 15 are connected to the single reference hydraulic pump 2 by means of connecting pipes 16.

Advantageously, the present disclosure allows the number of drives of the pressurization system to be minimized thereby protecting the electromechanical devices being involved.

Further, the method according to the disclosure allows only one measured physical parameter to be adopted, such as pressure, minimizing problems deriving from possible measurement errors.

Still further, the present disclosure allows a highly efficient pressurization system with mutually independent hydraulic pumps to be created in a cost-effective way.

A person skilled in the art will also appreciate how the present disclosure can be implemented in pre-existing assemblies without particular expedients.

The person skilled in the art will understand that the presented embodiment can be subject to various modifications and changes, according to specific and contingent requirements, all falling within the scope of protection of the disclosure, as defined by the following claims.

The invention claimed is:

1. A method, comprising:

setting a plurality of predetermined parameters in a plurality of electronic control units operable to independently control respectively a plurality of hydraulic pumps in a pressurization system, wherein each of the plurality of electronic control units configured at a respective one of the plurality of hydraulic pumps;

detecting a plurality of pressure values by means of the at least one pressure sensor at a delivery duct of each of said hydraulic pumps;

calculating at least one first derivative of an interpolating function of said plurality of values by means of a respective electronic control unit at each of said hydraulic pumps; and wherein said electronic control units managing and interpolating said predetermined parameters and said interpolating function of said plurality of values at each of said hydraulic pumps and said electronic control units determining a drive in a sequential manner, a synchronized manner, or a combination of a sequential manner and a synchronized manner of said hydraulic pumps.

2. A method according to claim 1, further comprising calibrating said pressurization system, wherein at least one system maximum pressure is defined and set.

3. A method according to claim 1, further comprising defining an operating range which is common to all of the hydraulic pumps of said pressurization system.

4. A method according to claim 1, further comprising generating a temporary index which is typical of each of said hydraulic pumps.

5. A pressurization system, comprising:

at least two hydraulic pumps;

at least one pressure sensor at a delivery duct of each of said hydraulic pumps; and at least two electronic control units configured respectively at said hydraulic pumps and configured to independently control said hydraulic pumps by:

setting a plurality of predetermined parameters in a plurality of electronic control units operable to independently control respectively a plurality of hydraulic pumps in a pressurization system, wherein each of the plurality of electronic control units configured at a respective one of the plurality of hydraulic pumps;

detecting a plurality of pressure values by means of the at least one pressure sensor at a delivery duct of each of said hydraulic pumps;

calculating at least one first derivative of an interpolating function of said plurality of values by means of a respective electronic control unit at each of said hydraulic pumps; and wherein said electronic control units managing and interpolating said predetermined parameters and said interpolating function of said plurality of values at each of said hydraulic pumps and said electronic control units determining a drive in a sequential manner, a synchronized manner, or a combination of a sequential manner and a synchronized manner of said hydraulic pumps.

6. The pressurization system of claim 5, wherein the at least two electronic control units are configured to:

set a plurality of user parameters;

detect at least one pressure value via said pressure sensor located at a delivery duct of each of the hydraulic pumps; and manage and interpolate said user parameters and said pressure value to determine a manner of driving the at least two hydraulic pumps.

7. A method for managing and protecting a pressurization system including at least two hydraulic pumps, comprising:

setting a plurality of user parameters in at least two electronic control units configured respectively for the hydraulic pumps and configured to independently control the hydraulic pumps;

detecting a plurality of pressure values by at least one pressure sensor at a delivery duct of each of said hydraulic pumps;

calculating at least one first derivative of an interpolating function of said plurality of values by a respective electronic control unit at each of said hydraulic pumps; and wherein a drive impulse in a sequential manner, a synchronized manner, or a combination of a sequential manner and a synchronized manner for said hydraulic pumps is determined managing and interpolating said user parameters and said interpolating function of said plurality of values by the respective electronic control unit of each pump.

8. The method of claim 7, further comprising calibrating said pressurization system, wherein at least one system maximum pressure is defined and set.

9. The method of claim 7, further comprising: defining an operating range common to all of the hydraulic pumps of said pressurization system.

10. The method of claim 7 further comprising generating a temporary index which is typical of each of said hydraulic pumps.

* * * * *